US005269375A

United States Patent [19]

Schroeder, Jr.

[11] Patent Number: 5,269,375

[45] Date of Patent: Dec. 14, 1993

[54] METHOD OF GRAVEL PACKING A WELL

[76] Inventor: Donald E. Schroeder, Jr., 7951 S. Adams Way, Littleton, Colo. 80122

[21] Appl. No.: 920,750

[22] Filed: Jul. 28, 1992

[51] Int. Cl.[5] ..... E21B 43/04; E21B 43/08; E21B 43/10

[52] U.S. Cl. ..... 166/278; 166/294

[58] Field of Search ..... 166/278, 276, 296, 51, 166/292, 294, 50, 312

[56] References Cited

U.S. PATENT DOCUMENTS 3,216,497 11/1965 Howard et al. ..... 166/278 X
3,273,641 9/1966 Bourne ..... 166/278
3,826,310 7/1974 Karnes ..... 166/276
3,880,233 4/1975 Muecke et al. ..... 166/205
4,018,282 4/1977 Graham et al. ..... 166/278
4,703,799 11/1987 Jennings, Jr. et al. ..... 166/278 X
5,062,484 11/1991 Schroeder, Jr. et al. ..... 166/278
5,165,476 11/1992 Jones ..... 166/278

*Primary Examiner*—Stephen J. Novosad

[57] ABSTRACT

A method of gravel packing a well. A flow-reducing material is introduced into the annulus between a tubular liner and the well bore so as to collect at the perforations in the well bore and the apertures in the liner. This slows gravel slurry flow to the screen inner annulus and to the perforations to prevent gravel from bridging the annulus at these locations. The material is removed after the risk of bridging has passed. Various flow-reducing materials, such as wax flakes, salt, clay and gel, may be employed. The method is particularly useful in deviated wells.

28 Claims, 2 Drawing Sheets

METHOD OF GRAVEL PACKING A WELL

FIELD OF THE INVENTION

This invention relates to a method of gravel packing a well penetrating a subterranean formation. More particularly, it relates to a method of preventing premature bridging of gravel during the packing of a well.

BACKGROUND OF THE INVENTION

Producing sand with well fluids from an unconsolidated subterranean oil or gas producing zone has long been a problem in the petroleum industry, causing erosion of production equipment and plugging of the well. Such conditions often result in reduced production levels or loss of well production entirely.

An effective means of combating the problem is the gravel pack, which involves placing a tubular liner in the well bore and packing gravel in the annulus between the liner and the well bore. The liner has slots or other apertures in its walls which are smaller in size than the gravel particles, thereby permitting formation fluids to flow through the slots while preventing entry of the particles. The small apertures may be provided by a screen encircling the outer circumference of the liner tube, in which case the openings in the tube may be larger than the gravel particles. As a result of improved gravel pack technology, gravel packs have become quite effective in excluding sand from oil and gas production. In addition to this function, the gravel also assists in supporting the walls of uncased wells and preventing caving of loose material against the liner. Despite the effectiveness of gravel packs once they are properly placed and operating, it is often difficult to install a uniform gravel pack due to the problem of premature bridging.

Gravel is commonly mixed with a fluid, such as a liquid or foam, to form a slurry which is introduced through a work string and a crossover tool into the annulus between the well bore and the liner. The slurry flows down the annulus to the bottom of the well bore or to a sump packer in the well bore. Some of the fluid of the slurry flows through the apertures in the liner into the open bottom end of a wash pipe situated within the liner and returns to the surface through the crossover tool and the annulus between the work string and the well casing. The balance of the slurry fluid flows into the subterranean zone through perforations in the well bore. Gravel is thus deposited in the annulus and against the subterranean zone.

Premature bridging can occur when the upstream perforations, that is, the perforations first encountered by the gravel slurry, fill with gravel from the gravel slurry and form deposits which impede the flow of the slurry down the annulus. When this occurs, the slurry follows the path of less resistance, which in this case is through the screen. This in turn accelerates the bridging action, as flow of the slurry fluid through the screen deposits gravel on the screen. While bridging in this manner can occur in a vertical well, the problem is more severe in a deviated well, where gravel transport through the horizontal well bore annulus is more difficult because it is not assisted by gravity.

A number of suggestions have been made over the years as to how to prevent bridging. One suggestion involves the use of a large diameter wash pipe, which reduces the size of the annulus, or the annulus clearance, between the wash pipe and the liner, thus increasing the resistance to flow through the annulus. This causes the carrier fluid to preferentially flow down the annulus between the well bore and the liner rather than pass through the liner openings. This method is not very effective, however, in limiting flow behind the screen and in preventing bridging at the top of the screen.

Another suggestion involves plugging the liner perforations with cement or other material prior to introducing the liner into the well bore, and then later removing the material by an acid treatment or some other separate removal operation. Complicated liner designs involving special liner flanges or valves at every liner joint have also been proposed. In addition, it has been suggested to provide material such as a semi-solid gel between the wash pipe and the liner in order to temporarily plug the liner openings until the top of the gravel pack reaches the openings. At that point the semi-solid gel offers less resistance to flow than the gravel pack itself, resulting in the liquid breaking through the gel and flowing down to the open end of the wash pipe. Still another method involves the use of a liner to seal the casing perforations and then carrying out the packing operation through use of new perforations. These various methods, however, either slow the gravel packing operation or make it less efficient. In the case of the method utilizing semi-solid gel to temporarily plug the liner openings, the gel is not designed to withstand the higher pressures sometimes encountered at locations other than at the perforations adjacent the top of the gravel pack, and so cannot be relied upon under all operating conditions.

It would be very beneficial to be able to reliably and consistently install gravel packs corresponding to gravel pack design parameters. It is therefore an object of the invention to prevent premature bridging in a gravel packing operation in a manner which does not impair or slow the gravel placement process.

BRIEF SUMMARY OF THE INVENTION

The method of the invention comprises positioning a tubular liner, which contains a plurality of apertures throughout at least a substantial portion of its length, within the perforated portion of a well bore penetrating a subterranean formation, thereby defining an annulus between the liner and the well bore. Flow-reducing material and a slurry comprised of gravel suspended in fluid are introduced into the annulus, with the flow-reducing material being introduced separately, either prior to the introduction of the gravel slurry or following placement of an initial portion of the slurry, or being mixed with an initial portion of the slurry. Some of the flow-reducing material collects at the well bore perforations and the liner apertures, slowing the flow of gravel into the perforations and apertures so as to prevent premature bridging of the gravel. After the packing operation has proceeded to the point where premature bridging is no longer a problem, the flow-reducing material is removed.

There is thus no need to pretreat or coat the liner to seal the liner or screen openings prior to moving the liner into place, nor is there a need to completely or permanently seal off the well casing perforations prior to moving the liner into place.

The flow-reducing material is not limited to any particular substance but may comprise any suitable material which is capable of substantially reducing flow through the well bore perforations and the liner openings, and which is capable of being readily removed after the packing operation has been completed or has proceeded to a point where premature bridging is no longer a risk. Preferably, the material should have a specific gravity less than that of water so that it is more concentrated at the perforations in upstream portions of the well bore than at perforations in downstream portions of the well bore. As discussed in more detail hereinafter, this tends to reduce the flow through such upstream perforations more quickly than through the perforations in downstream portions of the well bore. Wax flakes, benzoic acid, salt particles, clay and gel are examples of such materials.

The features enabling the method of the invention to provide the desired functions are brought out in more detail below in connection with the description of the preferred embodiments, wherein the above and other aspects of the invention, as well as other benefits, will readily be apparent.

DETAILED DESCRIPTION OF THE PREFERRED EMBODIMENTS

Figure 1:
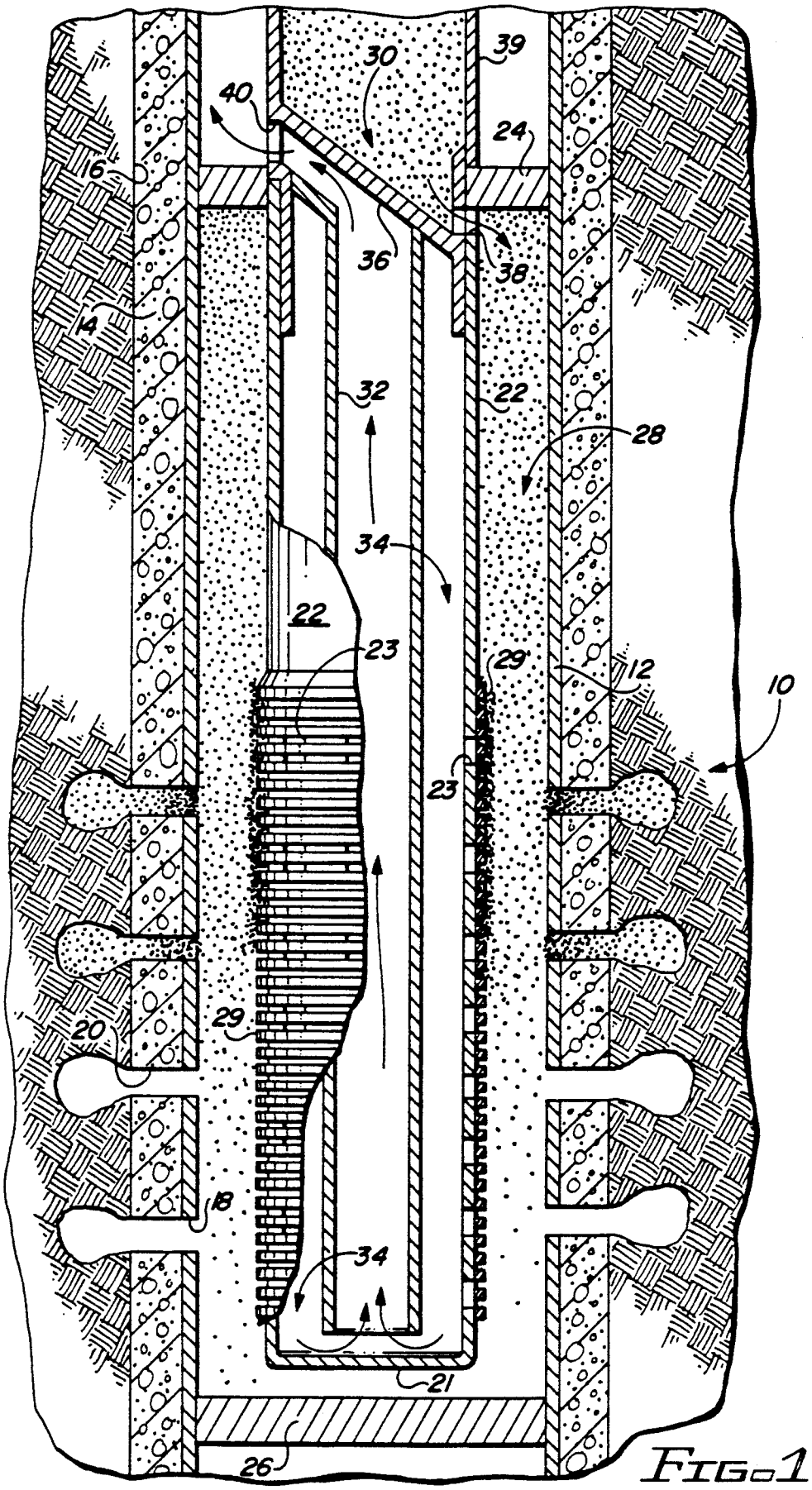
FIG. 1 is a simplified partial longitudinal sectional view of a well undergoing a gravel packing operation in accordance with the method of the present invention.

Referring to FIG. 1, a typical oil or gas well which penetrates a production formation 10 comprises a casing 12 cemented at 14 to the well bore 16. The casing and cement contain perforations 18 and 20, respectively, through which production fluid is intended to flow. Although a cased well has been shown for purpose of illustration, it will be understood that the invention can also readily be used in connection with an uncased well. Therefore, the term "well bore" as used herein refers to the area inside a cased or an uncased well. Although the invention normally is utilized in connection with a well for producing fluid from a subterranean formation, those skilled in the art will recognize that it may also be employed in connection with a well used to inject fluid into a subterranean formation.

A tubular liner 22 containing apertures 23 depends from a packer 24 down to a point spaced a short distance from a packer 26, which may be either a sump packer or a packer separating zones in a multiple completion. It will be understood that alternatively the liner could extend down to a point spaced a short distance from the bottom of the well bore instead of to an intermediate packer if the production formation were adjacent the bottom of the well bore. The liner 22, which is spaced from the casing 12 to create annulus 28, is illustrated as being covered by screen 29. The screen 29, if employed, may be of any known prior art design, conventionally being formed so that the screen openings are of smaller size than the apertures 23. If a screen is not employed, the liner would contain apertures typically in the nature of slits, the greatest dimension of which would preferably be smaller than the size of the gravel used in a gravel packing operation, but in practice may often be 3 or 4 times larger than the size of the gravel due to the difficulty in forming small slits. In such a case, gravel bridging is relied upon to prevent passage of gravel through the screen.

A cross-over tool 30 is supported by the packer 24 and includes wash pipe 32 spaced from the liner 22 to create annulus 34. The bottom of the wash pipe is spaced from the bottom wall 21 of the liner 22 to allow fluid to enter the wash pipe from within the liner. The cross-over tool 30 includes diverter means 36 for directing a gravel slurry through ports 38 in the liner to cause the slurry to enter the annulus 28 and to allow carrier fluid to flow from the wash pipe 32 to the surface through ports 40. The apertures 23 in liner 22 permit the flow of production fluid through the liner during a production operation, or gravel pack and other fluids during the completion operations.

The structure described to this point is conventional in gravel packing operations. According to the present invention, instead of introducing a conventional gravel slurry to the annulus 28 a special flow-reducing material is introduced as a preliminary treatment step. The flow-reducing material may be introduced separately, either prior to introducing the gravel or after an initial portion of a gravel stage has been placed, or it may be introduced with the initial portions of the gravel pack material.

Figures 2, 3:
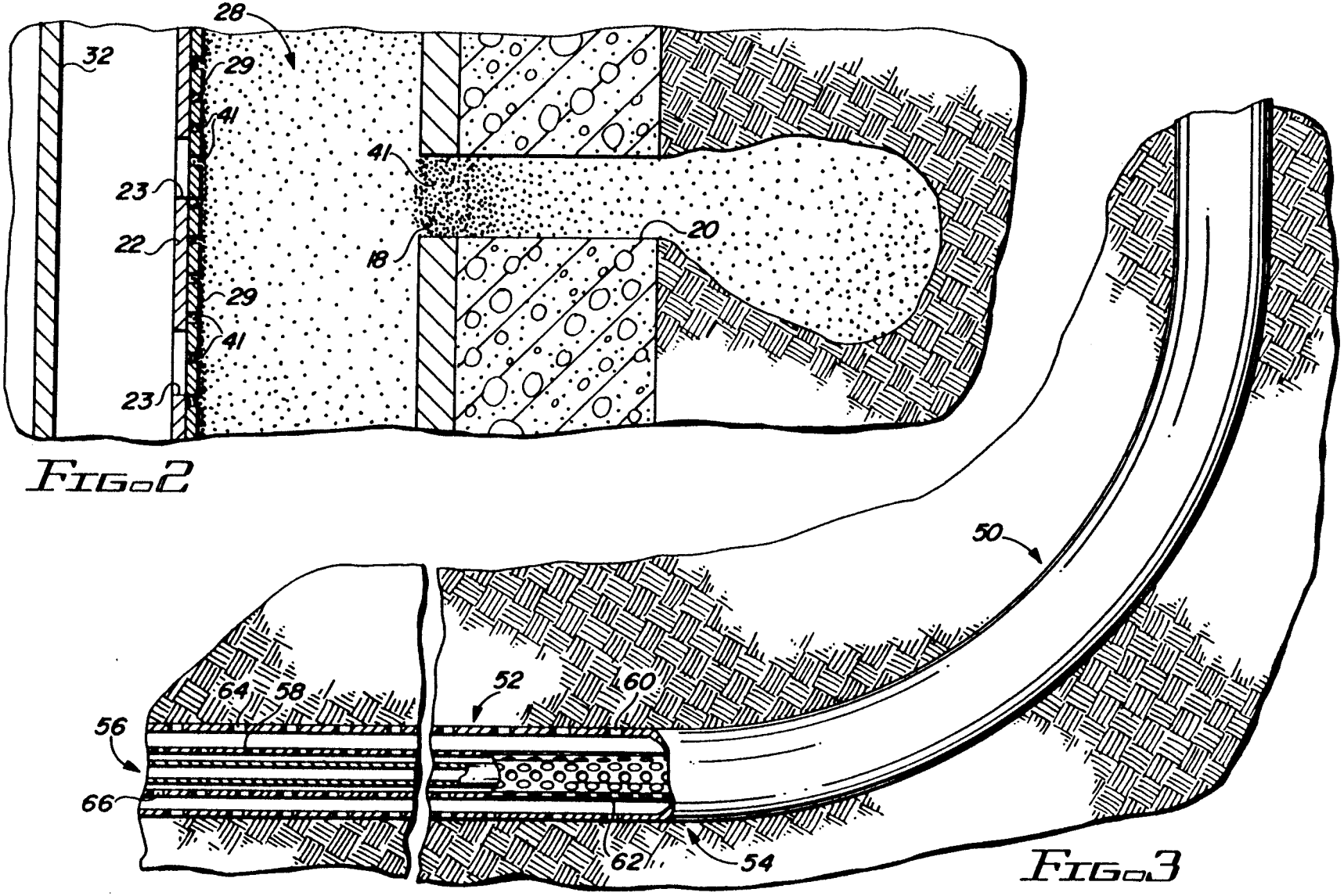
FIG. 2 is an enlarged partial longitudinal sectional view of a portion of the well bore and liner, illustrating the temporary plugging or flow reduction of a well bore perforation and liner apertures.
FIG. 3 is a simplified partial longitudinal sectional view of a deviated well to be gravel packed in accordance with the invention.

Referring to FIGS. 1 and 2, a fluid mixture or slurry of flow-reducing material is shown moving through the work string 39 and the ports 38 into the annulus 28 either after an initial portion of the gravel has been placed or with an initial portion of the gravel slurry. The overbalance pressure at the perforated interval, which is the amount of pressure in the well bore from the hydrostatic head that exceeds the reservoir pressure, causes the fluid to flow through the perforations 18 and 20 in the casing and cement and the apertures 23 in the liner 22, depositing the flow-reducing material in the perforations 18 and 20, on the screen 29 covering the liner and in the formation adjoining the perforations. Such deposited flow-reducing material is indicated by reference numeral 41 in FIG. 2. By limiting the amount of flow-reducing material introduced to the annulus 28 to the quantity necessary to cover or fill the well bore perforations and liner apertures in the upstream portion of the annulus 28, as illustrated by the particles shown in FIG. 1, or in high permeability zones which flow very easily and may be located anywhere in the well bore, subsequent introduction of gravel slurry will preferentially seek the perforations and apertures in the downstream portion of the annulus. This allows a more complete packing of the lower or downstream perforations and the lower portions of the annulus without danger of bridging occurring in the manner explained above. By knowing the dimensions of the annular space to be packed, the concentration of flow-reducing material in the carrier fluid and the rate of flow of the slurry, the length of time that the slurry should be pumped into the annulus can readily be calculated by those skilled in the art.

When flow-reducing material is incorporated in an initial portion of the gravel slurry, it is introduced for an initial period of time calculated to cover or fill the upstream well bore perforations and liner apertures, after which the introduction of flow-reducing material is terminated. The introduction of the gravel slurry is continued until the gravel pack is in place. The introduction of flow-reducing material into the gravel slurry will typically occur with respect to the first 10% to 20% of gravel slurry volume.

The introduction of flow-reducing material can also be carried out by flowing it into the annulus 28 prior to the introduction of gravel for a period of time calculated to cover or fill the upstream well bore perforations and liner apertures.

Regardless of the particular method of introducing the flow-reducing material, the material should be capable of moderately or substantially reducing fluid flow through the well bore perforations and liner apertures in which the material has been deposited. In many cases it would be desirable for the flow-reducing material to have a specific gravity less than the specific gravity of water to facilitate deposition of the material at the upstream perforations and apertures. Further, the material must be readily removable, without damaging the formation, so as not to hinder production of the well, and preferably should be easy to handle and control.

As stated above, the invention is applicable to deviated wells, an example of which is shown in FIG. 3. The well bore has a portion 50 which extends vertically, or at a substantial angle to the horizontal, and a horizontal leg 52 extending from the heel 54 to the toe 56. It is understood that the tubular liner 58 in the well bore may be similar in construction to the liner 22 of FIGS. 1 and 2. The gravel packing operation in a deviated well would proceed in the same manner as described above, with the flow-reducing material introduced into the annulus between the liner and the casing first encountering the more upstream perforations 60 and liner apertures 62, causing the gravel slurry in a gravel packing operation to seek the more downstream well casing perforations 64 and liner apertures 66.

Various flow-reducing materials may be employed as desired, as long as they are capable of performing in the manner described above. For example, wax flakes can be used to temporarily block the screen and upper perforations. Because the wax melts at higher temperatures, the blockage remains in place only until the temperature increases sufficiently. Such a system has the advantage of not requiring the addition of any secondary agents to remove the flow-reducing material.

Salt particles can also be utilized to reduce fluid flow. Preferably, the salt particles are introduced by a saturated carrier fluid. Subsequent introduction of fresher water dissolves the salt and opens the plugged openings.

Benzoic acid, which has only limited solubility in water and will thus slowly dissolve after being set in place, is another prime candidate.

Another candidate material is clay, which can be put into place by means of a slurry and subsequently removed by mud acid. Still another possible material is a gel of suitable viscosity to plug or reduce the flow through the well bore perforations and liner openings. The gel must be capable of being broken and reverting to liquid form by a suitable breaker introduced after the gravel pack has been put into place. Such gels may comprise, for example, a crosslinked polymer, such as a carboxylate-containing polymer crosslinked with a crosslinking agent comprising a chromic carboxylate complex. Exemplary synthetic polymers include acrylamide polymers, such as polyacrylamide and partially hydrolyzed polyacrylamide, crosslinked with chromic triacetate. As is known in the art, a number of different types of breakers, including oxidizing agents strong chemical breakers, chelating agents and organic chemicals can be used. Those skilled in the art of gelation will recognize that other gel systems and associated breakers in addition to those mentioned may also be utilized in this invention.

It will be understood that the flow-diverting phenomena caused by the material introduced to the well bore annulus may vary depending upon the material employed. Thus if the material is particulate in nature, a layer of the material collected at a perforation or aperture may not completely seal or plug the opening but may instead only substantially reduce fluid flow through the opening. Such treatment is adequate, however, as long as the flow through the opening is sufficiently reduced to cause the gravel slurry to seek a path of less resistance, resulting in the gravel slurry preferentially flowing toward the bottom of the well bore annulus and depositing gravel in the lower portion of the annulus. If the material is capable of sealing an opening, such as, for example, in the case of certain gels and other materials, only enough of the material should be used to cause the gravel fluid to be diverted downstream.

In any of the methods suggested above, it is preferred to provide larger liner apertures in the bottom or downstream portion of the liner in order to prevent unintentional plugging of all liner openings. A prepacked wire screen incorporating a layer of sand may be employed instead of a conventional screen, if desired, in which case the bottom section of the screen would be in the form of a conventional screen in order to cover the lowermost liner openings.

As previously noted, the present method is especially useful in combating premature bridging in deviated wells, where the problem is normally greater than with vertical wells due to the effect of gravity enhancing the flow of sand into the annulus through the deviated well bore perforations. The flow-reducing material employed in the invention is readily deposited in these high flowing perforations, thereby preventing deposits which would restrict annular flow, as a result of the flow path of its carrier fluid.

It will be understood by those skilled in the art that after completion of the gravel packing operation and removal of the flow-reducing material, the wash pipe and crossover tool will be removed and production tubing sealed to the liner. Formation fluid can then be produced through the perforations and the gravel pack.

It should now be understood that the invention provides a method of gravel packing a well which prevents premature bridging of the upper portion of the well bore annulus, thereby ensuring the proper placement of a gravel pack. The method is simple to carry out and is economical, requiring only a modest amount of added material for reducing the flow of the gravel carrier fluid through perforations and apertures in the upper portion of the well bore annulus.

It will be appreciated that the invention is not necessarily limited to all the specific details described in connection with the preferred embodiments, but that changes which do not alter the overall basic function and concept of the invention may be made to certain features of the preferred embodiments without departing from the spirit and scope of the invention, as defined in the appended claims.

What is claimed is:

1. A method of gravel packing a well bore penetrating a subterranean formation, wherein the well bore contains perforations communicating with the formation throughout a portion of the length of the well bore, comprising:

positioning a tubular liner within the perforated portion of the well bore, thereby defining an annulus between the liner and the well bore, the tubular liner containing a plurality of apertures throughout at least a substantial portion of the length thereof;

introducing flow-reducing material into the annulus;

introducing a slurry comprised of gravel suspended in fluid into the annulus;

at least a portion of the flow-reducing material collecting at the well bore perforations and the liner apertures, slowing the flow of gravel into the perforations and apertures so as to prevent premature bridging of the gravel; and removing the flow-reducing material after the packing operation has proceeded to the point where there is little chance of premature bridging occurring.

2. The method of claim 1, wherein the well bore extends at an angle to the vertical.

3. The method of claim 2, wherein the flow-reducing material collects substantially sequentially from the upstream to the downstream perforations and apertures.

4. The method of claim 3, wherein the flow-reducing material is introduced into the annulus in an aqueous medium and wherein the material has a specific gravity less than the specific gravity of water.

5. The method of claim 1, wherein the flow-reducing material is introduced into the annulus in an aqueous medium.

6. The method of claim 1, wherein the flow-reducing material is introduced into the annulus by intermingling the material with an initial portion of the gravel slurry introduced into the annulus.

7. The method of claim 6, wherein the flow-reducing material is introduced with the first 10%-20%, by volume, of the introduced gravel slurry.

8. The method of claim 1, wherein the flow-reducing material is introduced into the annulus after an initial portion of the gravel slurry has been placed in the well bore.

9. The method of claim 1, wherein the flow-reducing material comprises particles which melt when subjected to heat above their melting point.

10. The method of claim 9, wherein the particles comprise wax flakes.

11. The method of claim 1, wherein the flow-reducing material comprises salt particles introduced in a saturated aqueous medium.

12. The method of claim 11, wherein the salt particles are removed by contacting them with unsaturated water.

13. The method of claim 1, wherein the flow-reducing material is benzoic acid introduced in an aqueous medium.

14. The method of claim 1, wherein the flow-reducing material comprises clay introduced in an aqueous medium.

15. The method of claim 14, wherein the clay is removed by contacting it with mud acid.

16. The method of claim 1, wherein the flow-reducing material comprises a viscous gel.

17. The method of claim 16, wherein the gel is removed by contacting it with a gel breaker.

18. The method of claim 1, wherein the well bore includes a casing.

19. The method of claim 1, wherein the liner includes a screen extending around the outer circumference thereof.

20. The method of claim 1, wherein a wash pipe is positioned within the liner, whereby fluid from the slurry flows through lower apertures in the liner and up the wash pipe to the surface during a gravel packing operation.

21. In a method of gravel packing a well bore penetrating a subterranean formation, wherein the well bore contains perforations communicating with the formation throughout a portion of the length of the well bore, and wherein a tubular liner is positioned within the perforated portion of the well bore, thereby defining an annulus between the liner and the well bore, the tubular liner containing a plurality of apertures throughout at least a substantial portion of the length thereof, and wherein a slurry of gravel suspended in fluid is introduced into the annulus, whereby the gravel is deposited and packed in the annulus and the slurry fluid is caused to flow through at least downstream apertures in the liner, the improvement comprising:

introducing flow-reducing material into the annulus prior to introducing substantial portions of the gravel slurry;

at least a portion of the flow-reducing material collecting at upstream well bore perforations and liner apertures, slowing the flow of gravel into the perforations and apertures so as to prevent premature bridging of the gravel; and removing the flow-reducing material after the packing operation has proceeded to the point where there is little chance of premature bridging occurring.

22. The method of claim 21, wherein the well bore extends at an angle to the vertical and wherein the flow-reducing material collects substantially sequentially from the upper to the lower perforations and apertures.

23. The method of claim 21, wherein the flow-reducing material has a specific gravity less than the specific gravity of water and is introduced into the annulus in an aqueous medium.

24. The method of claim 21, wherein the flow-reducing material is introduced into the annulus by intermingling the material with an initial portion of the gravel slurry introduced into the annulus.

25. The method of claim 21, wherein the flow-reducing material comprises particles which melt when subjected to heat above their melting point.

26. The method of claim 21, wherein the flow-reducing material comprises salt particles introduced in a saturated aqueous medium and removed by contacting them with unsaturated water.

27. The method of claim 21, wherein the flow-reducing material comprises clay introduced in an aqueous medium and removed by contacting it with mud acid.

28. The method of claim 21, wherein the flow-reducing material comprises a viscous gel which is removed by contacting it with a gel breaker.

* * * * *